US006753722B1

(12) United States Patent
Kondapalli et al.

(10) Patent No.: US 6,753,722 B1
(45) Date of Patent: Jun. 22, 2004

(54) METHOD AND APPARATUS FOR VOLTAGE REGULATION WITHIN AN INTEGRATED CIRCUIT

(75) Inventors: Venu M. Kondapalli, Sunnyvale, CA (US); Martin L. Voogel, Los Altos, CA (US); Philip D. Costello, Saratoga, CA (US)

(73) Assignee: Xilinx, Inc., San Jose, CA (US)

( * ) Notice: Subject to any disclaimer, the term of this patent is extended or adjusted under 35 U.S.C. 154(b) by 0 days.

(21) Appl. No.: 10/354,560

(22) Filed: Jan. 30, 2003

(51) Int. Cl.[7] ..... G05F 1/10
(52) U.S. Cl. ..... 327/540
(58) Field of Search ..... 327/309, 318, 327/321, 323, 530, 534, 535, 538, 540, 541, 543

(56) References Cited

U.S. PATENT DOCUMENTS 5,994,950 A * 11/1999 Ochi ..... 327/543
6,333,669 B1 * 12/2001 Kobayashi et al. ..... 327/541
6,414,537 B1 * 7/2002 Smith ..... 327/540

* cited by examiner

*Primary Examiner*—Jeffrey Zweizig
(74) *Attorney, Agent, or Firm*—W. Eric Webostad; Kim Kanzaki

(57) ABSTRACT

Method and apparatus for regulating voltage within an integrated circuit is described. For example, a voltage regulator receives a first reference voltage and produces a regulated voltage. A comparator includes a first input for receiving a second reference voltage and a second input for receiving the regulated voltage. The comparator includes an offset voltage. The comparator produces a control signal indicative of whether the difference between the second reference voltage and the regulated voltage is greater than a predetermined offset voltage. A clamp circuit clamps the regulated voltage to the second reference voltage in response to the control signal. In another example, the clamp circuit is removed and a multiplexer selects either a first reference voltage or a second reference voltage to be coupled to a voltage regulator. The multiplexer is controlled via output of a comparator that compares the first reference voltage and the second reference voltage.

17 Claims, 3 Drawing Sheets

METHOD AND APPARATUS FOR VOLTAGE REGULATION WITHIN AN INTEGRATED CIRCUIT

FIELD OF THE INVENTION

One or more aspects of the present invention relate generally to voltage regulation within an integrated circuit and, more particularly, to regulation of switch circuit gate voltage within a programmable logic device.

BACKGROUND OF THE INVENTION

Programmable logic devices (PLDs) exist as a well-known type of integrated circuit (IC) that may be programmed by a user to perform specified logic functions. There are different types of programmable logic devices, such as programmable logic arrays (PLAs) and complex programmable logic devices (CPLDs). One type of programmable logic devices, known as a field programmable gate array (FPGA), is very popular because of a superior combination of capacity, flexibility, time-to-market, and cost.

An FPGA typically includes an array of configurable logic blocks (CLBs) surrounded by a ring of programmable input/output blocks (IOBs). The CLBs and IOBs are interconnected by a programmable interconnect structure. The CLBs, IOBs, and interconnect structure are typically programmed by loading a stream of configuration data (bitstream) into internal configuration memory cells that define how the CLBs, IOBS, and interconnect structure are configured. The configuration bitstream may be read from an external memory, conventionally an external integrated circuit memory EEPROM, EPROM, PROM, and the like, though other types of memory may be used. The collective states of the individual memory cells then determine the function of the FPGA.

The programmable interconnect structure typically includes switch circuits (also known as switch boxes) for interconnecting the various logic blocks within an FPGA. Switch circuits generally include pass transistors for forming programmable connections between input/output lines of logic blocks in response to a gate voltage. A voltage regulator provides and regulates the gate voltage that drives the gates of the pass transistors. As is well known in the art, the speed of propagation of a signal through such a switch circuit improves with higher gate voltage applied to the gates of the pass transistors.

One method employed by others to provide relatively high gate voltage to pass transistors in a switch circuit is to clamp the gate voltage to an internal supply source, $V_{cc}$, when the internal supply source rises above a target gate voltage. However, known voltage regulators are susceptible to one or more of intrinsic voltage offsets caused by process variations and differences in physical layout of the voltage regulator components, though such physical layout may be intended to be symmetric. One or more of these intrinsic voltage offsets may cause the voltage regulator to become unstable thereby producing oscillations in the output voltage, for example.

Accordingly, it would be both desirable and useful to provide a method and apparatus for voltage regulation within an IC that is less susceptible to one or more intrinsic voltage offsets.

SUMMARY OF THE INVENTION

Method and apparatus for voltage regulation within an integrated circuit is described. In an embodiment in accordance with one or more aspects of the invention, a voltage regulator receives a first reference voltage and provides a regulated voltage. A comparator includes a first input to receive a second reference voltage and a second input to receive the regulated voltage. The comparator includes an offset voltage. The comparator provides a control signal indicative of whether the difference between the second reference voltage and the regulated voltage is greater than the offset voltage. A voltage clamp circuit clamps the regulated voltage to the second reference voltage in response to the control signal.

In another embodiment in accordance with one or more aspects of the invention, a comparator compares a first reference voltage with a second reference voltage. The comparator provides a control signal indicative of which of the first reference signal and the second reference signal is greater. A multiplexer provides either the first reference voltage or the second reference voltage as output in response to the control signal. A regulator receives the output of the multiplexer and provides a regulated voltage.

BRIEF DESCRIPTION OF THE DRAWINGS

Accompanying drawing(s) show exemplary embodiment (s) in accordance with one or more aspects of the invention; however, the accompanying drawing(s) should not be taken to limit the invention to the embodiment(s) shown, but are for explanation and understanding only.

DETAILED DESCRIPTION OF THE DRAWINGS

Method and apparatus for voltage regulation within an integrated circuit (IC) is described. One or more aspects in accordance with the invention are described in terms of gate voltage regulation of pass transistors within a programmable logic device (PLD). While specific reference is made to regulating gate voltage of pass transistors, those skilled in the art will appreciate that one or more aspects of the invention may be used to regulate other voltages used for various applications within an IC device.

Figure 1:
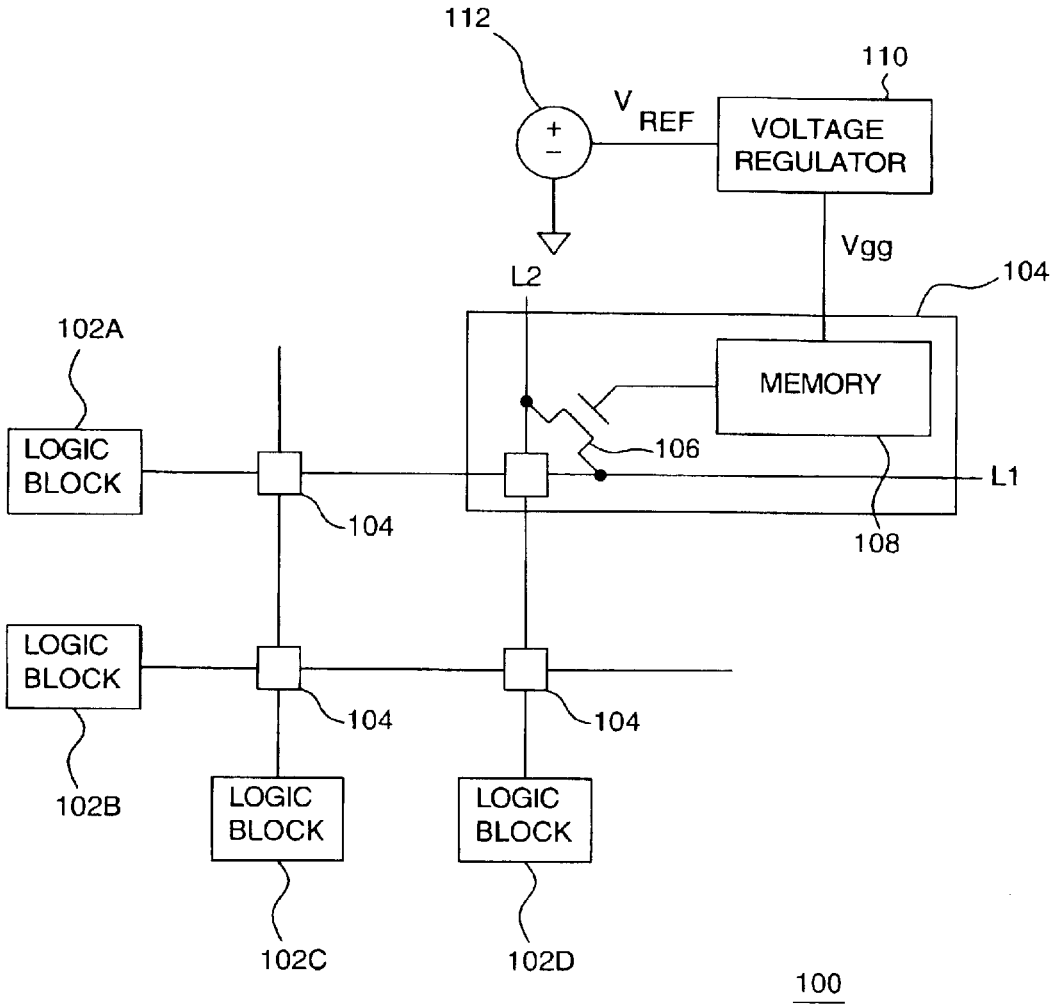
FIG. 1 depicts a block diagram showing an exemplary portion of a programmable logic device in which one or more aspects of the invention are useful.

FIG. 1 depicts a block diagram showing a portion of an exemplary PLD 100. PLD 100 is illustratively shown as including logic blocks 102A through 102D (collectively referred to as logic blocks 102), and switch circuits 104. Logic blocks 102 comprise CLBs, IOBs, or like type well-known circuits. Switch circuits 104 comprise one or more pass transistors, memory cells, and multiplexer circuits, as is well known in the art. Logic blocks 102 are programmably connectable by configuring switch circuits 104 in a well-known manner. An exemplary embodiment of switch circuit 104 is illustratively shown as including a pass transistor 106 and a memory cell 108. Memory cell 108 is coupled to the gate of pass transistor 106 for activating or deactivating pass transistor 106. Pass transistor 106 comprises, for example, an NMOS or a PMOS transistor. Memory cell 108 comprises, for example, SRAM, EPROM, EEPROM, flash memory, antifuse pull-up or pull-down circuits, or any other type of well-known programmable memory cell.

If pass transistor 106 is activated, line L2 is coupled to line L1, and thus logic block 102D is coupled to logic block 102A. Otherwise, when pass transistor 106 is deactivated, line L2 is not coupled to line L1. Memory cell 108 drives the gate of pass transistor 106 with a gate voltage $V_{gg}$ for activation/deactivation. Memory cell 108 receives gate voltage $V_{gg}$ from a voltage regulator 110. Voltage regulator 110 is coupled to a voltage source 112, which produces a reference voltage $V_{ref}$. Reference voltage $V_{ref}$ is a target gate voltage, or a fraction of a target gate voltage, for pass transistor 106 and is regulated by voltage regulator 110 to provide gate voltage $V_{gg}$.

Figure 2:
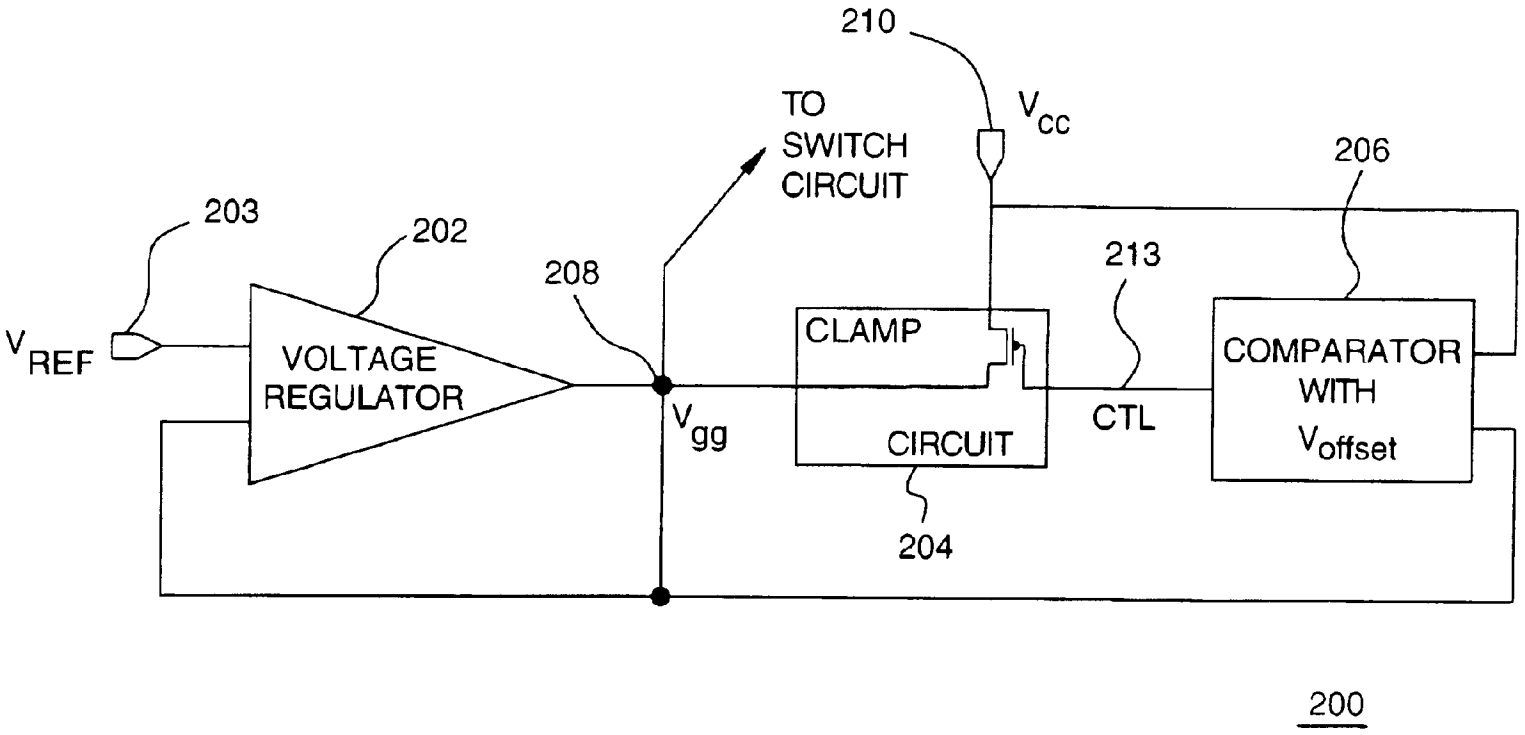
FIG. 2 depicts a block diagram of an exemplary embodiment of a voltage regulator in accordance with one or more aspects of the invention.

FIG. 2 depicts a block diagram of an exemplary embodiment of a voltage regulation circuit 200 in accordance with one or more aspects of the invention. Voltage regulation circuit 200 may be used as voltage regulator 110 shown in FIG. 1 and is described in this context. Voltage regulation circuit 200 includes a reference voltage terminal $V_{ref}$ 203, a gate voltage terminal $V_{gg}$ 208, a supply voltage terminal $V_{cc}$ 210, a voltage regulator 202, a clamp circuit 204, and a comparator 206. Voltage regulator 202 and comparator 206 are circuits known to one of ordinary skill in the art. In one embodiment, clamp circuit 204 is a PMOS transistor, as shown in FIG. 2, whose gate is coupled to CTL 213, and whose source and drain are respectively coupled to Vcc 210 and Vgg 208. However, other embodiments may be used for or in clamp circuit 204, including an NMOS transistor instead of a PMOS transistor or another clamp circuit known to one of ordinary skill in the art. Reference voltage terminal $V_{ref}$ 203 is provided a reference voltage $V_{ref}$; supply voltage terminal $V_{cc}$ 210 is provided a supply voltage $V_{cc}$; and gate voltage terminal $V_{gg}$ 208 provides a gate voltage $V_{gg}$. Reference voltage $V_{ref}$ is a target voltage level, or a fraction of a target voltage level, for gate voltage $V_{gg}$.

Inputs of voltage regulator 202 are respectively coupled to reference voltage terminal $V_{ref}$ 203 and gate voltage terminal $V_{gg}$ 208. An output of voltage regulator 202 is coupled to gate voltage terminal $V_{gg}$ 208. Voltage regulator 202 operates in a well-known manner. Voltage regulator 202 produces gate voltage $V_{gg}$ responsive to reference voltage $V_{ref}$. When the level of gate voltage $V_{gg}$ drops below the level of reference voltage $V_{ref}$ (or a fraction thereof), regulator 202 increases the level of gate voltage $V_{gg}$.

Inputs of comparator 206 are respectively coupled to supply voltage terminal $V_{cc}$ 210 and gate voltage terminal $V_{gg}$ 208. Comparator 206 includes a control terminal CTL 213. Comparator 206 produces a control signal CTL at control terminal CTL 213 responsive to supply voltage $V_{cc}$ and gate voltage $V_{gg}$. Comparator 206 includes a built-in offset voltage $V_{offset}$, which affects the trip point of comparator 206. The trip point of comparator 206 is the point at which the difference between supply voltage $V_{cc}$ and gate voltage $V_{gg}$ causes a change of state of control signal CTL. Instead of a trip point of zero, the trip point is set to $V_{offset}$, which can be a positive or a negative offset voltage. That is, comparator 206 drives control signal CTL to a first state if the difference between supply voltage $V_{cc}$ and gate voltage $V_{gg}$ is greater than offset voltage $V_{offset}$ ($V_{cc}-V_{gg}>V_{offset}$). Comparator drives control signal CTL to a second state if the difference between supply voltage $V_{cc}$ and gate voltage $V_{gg}$ is less than offset voltage $V_{offset}$ ($V_{cc}-V_{gg}<V_{offset}$).

As described in more detail below, magnitude of offset voltage $V_{offset}$ is selected to be greater than an intrinsic offset voltage of comparator 206. In an embodiment, offset voltage $V_{offset}$ is a fixed parameter. For example, an offset can be built into comparator 206 by intentionally mismatching the sizes of transistors of comparator 206 that are coupled to the input terminals of comparator 206. Alternatively, offset voltage $V_{offset}$ may be programmably adjusted during operation of voltage regulation circuit 200 by programmably selecting a different amount of mismatch between the sizes of transistors of comparator 206 that are coupled to input terminals of comparator 206.

Inputs of clamp circuit 204 are respectively coupled to control terminal CTL 213 and supply voltage terminal $V_{cc}$ 210. An output of clamp circuit 204 is coupled to gate voltage terminal $V_{gg}$ 208. If activated, clamp circuit 204 causes gate voltage $V_{gg}$ to follow supply voltage $V_{cc}$. Activation of clamp circuit 204 is responsive to control signal CTL.

In operation, the voltage level of reference voltage $V_{ref}$ is selected to be a target voltage level (or some fraction of a target voltage level) for gate voltage $V_{gg}$. Voltage regulation circuit 200 has two modes of operation. In a first mode, supply voltage $V_{cc}$ is less than a sum of gate voltage $V_{gg}$ and offset voltage $V_{offset}$ (i.e., $V_{cc}<V_{gg}+V_{offset}$). In a second mode, supply voltage $V_{cc}$ is greater than a sum of gate voltage $V_{gg}$ and offset voltage $V_{offset}$ (i.e., $V_{cc}>V_{gg}+V_{offset}$). Stated differently, the difference between supply voltage $V_{cc}$ and gate voltage $V_{gg}$ is compared with offset voltage $V_{offset}$. In the first mode ($V_{cc}<V_{gg}+V_{offset}$), the difference is less than offset voltage $V_{offset}$. In the second mode ($V_{cc}>V_{gg}+V_{offset}$), the difference is greater than offset voltage $V_{offset}$.

In the first mode ($V_{cc}<V_{gg}+V_{offset}$), voltage regulation circuit 200 causes gate voltage $V_{gg}$ to follow reference voltage $V_{ref}$. Thus, as long as supply voltage $V_{cc}$ remains below the target voltage level for gate voltage $V_{gg}$ plus offset voltage $V_{offset}$, voltage regulation circuit 200 will cause gate voltage $V_{gg}$ to follow reference voltage $V_{ref}$.

In the second mode ($V_{cc}>V_{gg}+V_{offset}$), voltage regulation circuit 200 causes gate voltage $V_{gg}$ to instead follow supply voltage $V_{cc}$, which is now above the target voltage level for gate voltage $V_{gg}$. In particular, supply voltage $V_{cc}$ is above the target voltage level for gate voltage $V_{gg}$ by an amount equal to offset voltage $V_{offset}$. Thus, as long as supply voltage $V_{cc}$ remains above the target voltage level for gate voltage $V_{gg}$ by an amount equal to offset voltage $V_{offset}$, voltage regulation circuit 200 will cause gate voltage $V_{gg}$ to follow supply voltage $V_{cc}$ instead of reference voltage $V_{ref}$. This allows voltage regulation circuit 200 to produce as high as possible gate voltage $V_{gg}$.

Moreover, comparator 206 compares supply voltage $V_{cc}$ with a sum of gate voltage $V_{gg}$ and offset voltage $V_{offset}$. If supply voltage $V_{cc}$ is less than the sum of gate voltage $V_{gg}$ and offset voltage $V_{offset}$, then comparator 206 drives control signal CTL to an inactive state (e.g., logically low in an active high embodiment). If control signal CTL 213 is in an inactive state, clamp circuit 204 is not active and does not clamp gate voltage $V_{gg}$ to the voltage level of supply voltage $V_{cc}$. Voltage regulator 202 thus causes gate voltage $V_{gg}$ to follow reference voltage $V_{ref}$. That is, if gate voltage $V_{gg}$ falls below reference voltage $V_{ref}$ (or some fraction thereof), voltage regulator 202 increases gate voltage $V_{gg}$.

If supply voltage $V_{cc}$ is greater than gate voltage $V_{gg}$ by an amount equal to $V_{offset}$, then comparator 206 drives control signal CTL 213 to an active state (e.g., logically high in an active high embodiment). If control signal CTL 213 is in the active state, clamp circuit 204 is active and clamps gate voltage $V_{gg}$ to the voltage level of supply voltage $V_{cc}$. In this case, supply voltage $V_{cc}$ is greater than reference voltage $V_{ref}$ by definition. Since gate voltage $V_{gg}$ is higher than reference voltage $V_{ref}$, voltage regulator 202 does not actively regulate gate voltage $V_{gg}$.

Offset voltage $V_{offset}$ allows voltage regulation circuit 200 to be less susceptible to an intrinsic offset within comparator 206 caused by, for example, random process variations. For example, random process variations during fabrication of comparator 206 may cause an intrinsic offset approximately between plus and minus five millivolts (±5 mV) to affect the trip point. Without a built-in offset voltage $V_{offset}$, a slightly negative intrinsic offset within comparator 206 can cause voltage regulation circuit 200 to become unstable. Specifically, an uncompensated intrinsic offset voltage results in both clamp circuit 204 and voltage regulator 202 being active at the same time, which could result in undesirable oscillations in gate voltage $V_{gg}$. That is, voltage regulator 202 will begin over-regulate to compensate for current drawn by clamp circuit 204. If claim circuit 204 deactivates, voltage regulator 202 will continue to over-regulate for some time, resulting in oscillations of gate voltage $V_{gg}$.

By building in offset voltage $V_{offset}$ to comparator 206, voltage regulation circuit 200 will maintain stability. For example, in an embodiment, offset voltage $V_{offset}$ is a positive voltage greater than the expected value of the intrinsic offset of comparator 206 (e.g., 50 mV). When clamp circuit 204 is actively clamping gate voltage $V_{gg}$ to the level of supply voltage $V_{cc}$, a drop in supply voltage $V_{cc}$ below the sum of gate voltage $V_{gg}$ and offset voltage $V_{offset}$ will cause clamp circuit 204 to be deactivated. Regulator circuit 202 also remains inactive until such time as gate voltage $V_{gg}$ drops below reference voltage $V_{ref}$ (or some fraction thereof). In this manner, a situation where both regulator 202 and clamp circuit 204 are active at the same time may be avoided (i.e., when $V_{gg}>V_{cc}$).

Offset voltage $V_{offset}$ may be built into comparator 206 to affect the trip point. In the above example, offset voltage $V_{offset}$ is positive. As an alternative, offset voltage $V_{offset}$ may be negative. In each embodiment, comparator 206 is comparing offset voltage $V_{offset}$ with the difference between supply voltage $V_{cc}$ and gate voltage $V_{gg}$.

Figure 3:
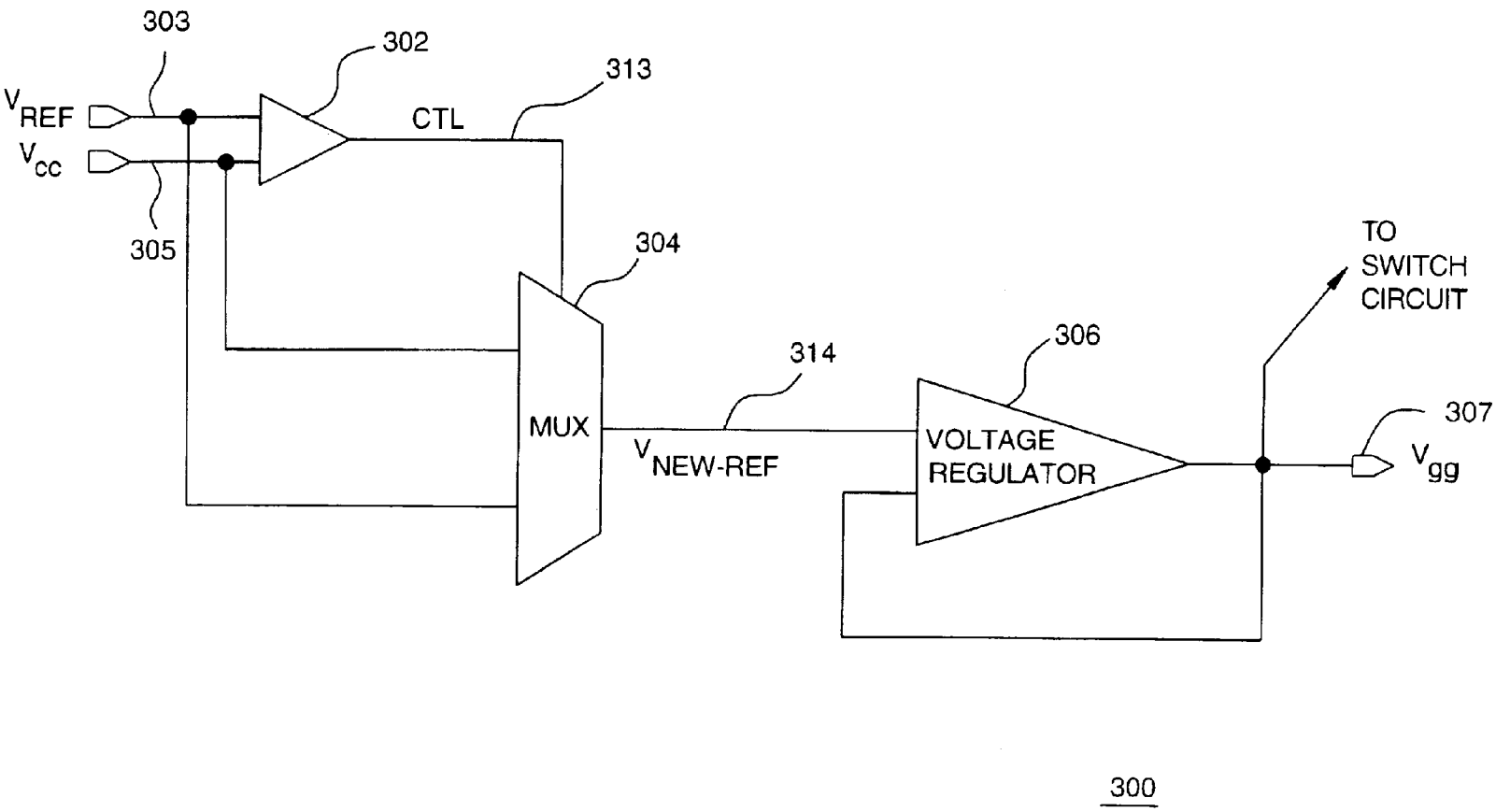
FIG. 3 depicts a block diagram of another exemplary embodiment of a voltage regulator in accordance with one or more aspects of the invention.

FIG. 3 depicts a block diagram of another exemplary embodiment of a voltage regulation apparatus 300 in accordance with one or more aspects of the invention. Voltage regulation apparatus 300 may be used as voltage regulator 110 shown in FIG. 1. Voltage regulation apparatus 300 comprises a reference voltage terminal $V_{ref}$ 303, a supply voltage terminal $V_{cc}$ 305, a gate voltage terminal $V_{gg}$ 307, a voltage regulator 306, a multiplexer 304, and a comparator 302. Reference voltage terminal $V_{ref}$ 303 is provided a reference voltage $V_{ref}$; supply voltage terminal $V_{cc}$ 305 is provided a supply voltage $V_{cc}$; and gate voltage terminal $V_{gg}$ 307 provides a gate voltage $V_{gg}$. Reference voltage $V_{ref}$ is a target voltage level, or a fraction of a target voltage level, for gate voltage $V_{gg}$.

Inputs of comparator 302 are respectively coupled to reference voltage terminal $V_{ref}$ 303 and supply voltage terminal $V_{cc}$ 305. Comparator 302 includes a control terminal CTL 313. Comparator 302 produces a control signal CTL on control terminal CTL 313 responsive to reference voltage $V_{ref}$ and supply voltage $V_{cc}$. Control signal CTL is in a first state if $V_{ref}$ is greater than $V_{cc}$. Control signal CTL is in a second state if $V_{ref}$ is less than $V_{cc}$.

Inputs of multiplexer 304 are respectively coupled to reference voltage terminal $V_{ref}$ 303 and supply voltage terminal $V_{cc}$ 305. A control terminal of multiplexer 304 is coupled to control terminal CTL 313. Multiplexer 304 includes an output terminal $V_{new_ref}$ 314. Multiplexer 304 produces a new reference voltage $V_{new_ref}$ on output terminal $V_{new_ref}$ 314 responsive to control signal CTL.

Inputs of voltage regulator 306 are respectively coupled to output terminal $V_{newref}$ 314 and gate voltage terminal $V_{gg}$ 307. An output of voltage regulator 306 is coupled to gate voltage terminal $V_{gg}$ 307. Voltage regulator 306 produces a gate voltage $V_{gg}$ responsive to new reference voltage $V_{new_ref}$.

In operation, the level of reference voltage $V_{ref}$ is selected to be the target voltage level for gate voltage $V_{gg}$. Voltage regulation apparatus 300 has two modes of operation. In a first mode, supply voltage $V_{cc}$ is less than reference voltage $V_{ref}$ (i.e., $V_{cc}<V_{ref}$). In a second mode, supply voltage $V_{cc}$ is greater than reference voltage $V_{ref}$ (i.e., $V_{cc}>V_{ref}$). In the first mode ($V_{cc}<V_{ref}$), voltage regulation apparatus 300 causes gate voltage $V_{gg}$ to follow reference voltage $V_{ref}$, which is the target voltage level for gate voltage $V_{gg}$. Thus, if supply voltage $V_{cc}$ remains below the target voltage level for gate voltage $V_{gg}$, voltage regulation apparatus 300 will cause gate voltage $V_{gg}$ to follow reference voltage $V_{ref}$.

In the second mode ($V_{cc}>V_{ref}$), voltage regulation apparatus 300 causes gate voltage $V_{gg}$ to instead follow supply voltage $V_{cc}$, which is now above the target voltage level for gate voltage $V_{gg}$. Thus, if supply voltage $V_{cc}$, remains above the target voltage level for gate voltage $V_{gg}$, voltage regulation apparatus 300 will cause gate voltage $V_{gg}$ to follow supply voltage $V_{cc}$ instead of reference voltage $V_{ref}$. This allows voltage regulation apparatus 300 to produce as high as possible gate voltage $V_{gg}$.

More specifically, comparator 302 compares reference voltage $V_{ref}$ with supply voltage $V_{cc}$. When supply voltage $V_{cc}$ is greater than reference voltage $V_{ref}$, comparator 302 drives control signal CTL to cause multiplexer 304 to select supply voltage $V_{cc}$. When supply voltage $V_{cc}$ is less than reference voltage $V_{ref}$, comparator 302 drives control signal CTL to cause multiplexer 304 to select reference voltage $V_{ref}$. If multiplexer 304 selects supply voltage $V_{cc}$, new reference voltage $V_{new_ref}$ 314 equals supply voltage $V_{cc}$. Voltage regulator 306 then causes gate voltage $V_{gg}$ to follow supply voltage $V_{cc}$. When multiplexer 304 selects reference voltage $V_{ref}$, new reference voltage $V_{new_ref}$ 314 equals reference voltage $V_{ref}$. Voltage regulator 306 then causes gate voltage $V_{gg}$ to follow reference voltage $V_{ref}$. In this manner, voltage regulation apparatus 300 does not require an additional clamp circuit. Voltage regulation apparatus 300 eliminates the problem caused by the interaction of a regulator and a clamp circuit attempting to control voltage level on a single node.

In addition, although voltage regulation circuit 200 of FIG. 2 solves the problem of large oscillations in gate voltage $V_{gg}$ due to voltage regulator 202 and clamp circuit 204 being active at the same time, voltage regulation circuit 200 causes small oscillations in gate voltage $V_{gg}$. Specifically, the intentional offset voltage $V_{offset}$ built into comparator 206 will prevent clamp circuit 204 from keeping gate voltage $V_{gg}$ equal to supply voltage $V_{cc}$. If gate voltage $V_{gg}$ is less than the difference between supply voltage $V_{cc}$ and offset voltage $V_{offset}$, clamp circuit 204 activates and gate voltage $V_{gg}$ will approach supply voltage $V_{cc}$ very rapidly. However, gate voltage $V_{gg}$ will not equal supply voltage $V_{cc}$ for long, since clamp circuit 204 deactivates after gate voltage $V_{gg}$ is greater than the difference between supply voltage $V_{cc}$ and offset voltage $V_{offset}$. Clamp circuit 204 continues to activate and deactivate, causing gate voltage $V_{gg}$ to oscillate approximately between supply voltage $V_{cc}$ and the difference between supply voltage $V_{cc}$ and offset voltage $V_{offset}$. A circuit receiving gate voltage $V_{gg}$ can function property with these small oscillations as compared to the large oscillations produced if clamp circuit 204 and voltage regulator 202 are both active at the same time.

Voltage regulation apparatus 300 of FIG. 3, however, avoids producing even small oscillations in gate voltage $V_{gg}$. Specifically, intrinsic voltage offsets within comparator 302 or voltage regulator 306 will not produce oscillations in gate voltage $V_{gg}$. Rather, such intrinsic voltage offsets will merely shift the final voltage level of gate voltage $V_{gg}$ by a small amount.

While the foregoing describes exemplary embodiment(s) in accordance with one or more aspects of the present invention, other and further embodiment(s) in accordance with the one or more aspects of the present invention may be devised without departing from the scope thereof, which is determined by the claim(s) that follow and equivalents thereof. Claim(s) listing steps do not imply any order of the steps.

What is claimed is:

1. A voltage regulation apparatus, comprising:

a voltage regulator having an input to receive a first reference voltage and an output to produce a regulated voltage;

a comparator having a first input to receive a second reference voltage, a second input to receive the regulated voltage, and an output to provide a control signal, the comparator including an offset voltage; and a voltage clamp to clamp the regulated voltage to the second reference voltage in response to the control signal.

2. The voltage regulation apparatus of claim 1, wherein the offset voltage is applied to a trip point of the comparator.

3. The voltage regulation apparatus of claim 1, wherein the offset voltage is a negative voltage.

4. The voltage regulation apparatus of claim 1, wherein the offset voltage is a positive voltage.

5. The voltage regulation apparatus of claim 1, wherein magnitude of the offset voltage is greater than an intrinsic offset voltage within the comparator.

6. The voltage regulation apparatus of claim 1, wherein the regulated voltage is coupled to gate a switch circuit in a programmable logic device.

7. The voltage regulation apparatus of claim 6, wherein the second reference voltage is a supply voltage of the programmable logic device.

8. The voltage regulation apparatus of claim 1, wherein the voltage clamp is a transistor coupled to clamp the regulated voltage to the second reference voltage in response to the control signal.

9. A method of regulating voltage, comprising:

producing a regulated voltage in response to a first reference voltage;

comparing a second reference voltage with the regulated voltage; and clamping the regulated voltage to the second reference voltage when a difference between the second reference voltage and the regulated voltage exceeds an offset voltage.

10. The method of claim 9, wherein magnitude of the offset voltage is greater than an intrinsic offset voltage.

11. The method of claim 9, further comprising:

providing a programmable logic device having a switch circuit; and coupling the regulated voltage to the switch circuit.

12. The method of claim 11, wherein the second reference voltage is a supply voltage within the programmable logic device.

13. A voltage regulation apparatus, comprising:

a first reference voltage input;

a second reference voltage input;

a reference voltage output;

a voltage regulator coupled to the first reference voltage input and the reference voltage output;

a comparator coupled to the second reference voltage input and the reference voltage output, the comparator configured with a voltage offset, the comparator having a comparator output; and a voltage clamp coupled to the second reference voltage input and the reference voltage output, the voltage clamp coupled to the comparator output.

14. The voltage regulation apparatus of claim 13, wherein magnitude of the offset voltage is greater than an intrinsic offset voltage within the comparator.

15. The voltage regulation apparatus of claim 13, wherein the reference voltage output is coupled to gate a switch circuit in a programmable logic device.

16. The voltage regulation apparatus of claim 15, wherein the second reference voltage output is coupled to a supply voltage of the programmable logic device.

17. The voltage regulation apparatus of claim 13, wherein the voltage clamp is a transistor having a gate terminal, a source terminal and a drain terminal, the gate terminal is coupled to the comparator output, the source terminal is coupled to the second reference voltage input, and the drain terminal is coupled to the reference voltage output.

* * * * *